US007082279B2

(12) United States Patent
Fujii et al.

(10) Patent No.: US 7,082,279 B2
(45) Date of Patent: Jul. 25, 2006

(54) TONER REPLENISHMENT DEVICE FOR USE IN ELECTROPHOTOGRAPHIC IMAGE FORMING APPARATUS

(75) Inventors: Ritsuo Fujii, Hachioji (JP); Seiji Yamaguchi, Hino (JP); Hiroshi Isokawa, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 11 days.

(21) Appl. No.: 10/948,578

(22) Filed: Sep. 24, 2004

(65) Prior Publication Data

US 2005/0201780 A1 Sep. 15, 2005

(30) Foreign Application Priority Data

Mar. 9, 2004 (JP) ..... 2004-065261

(51) Int. Cl.
*G03G 15/08* (2006.01)

(52) U.S. Cl. ..... 399/258; 399/252

(58) Field of Classification Search ..... 399/258, 399/262, 252, 359
See application file for complete search history.

(56) References Cited

U.S. PATENT DOCUMENTS 3,963,924 A * 6/1976 Boag et al.
5,909,609 A * 6/1999 Yahata et al. ..... 399/258
5,950,055 A * 9/1999 Yahata et al. ..... 399/252
6,829,463 B1 * 12/2004 Fujii et al. ..... 399/258
2003/0142999 A1 * 7/2003 Fujii et al. ..... 399/258

FOREIGN PATENT DOCUMENTS

JP 2000-137376 5/2000

* cited by examiner

*Primary Examiner*—Arthur T. Grimley
*Assistant Examiner*—Laura K. Roth
(74) *Attorney, Agent, or Firm*—Finnegan, Henderson, Farabow, Garrett & Dunner, L.L.P.

(57) ABSTRACT

A toner replenishment device has: a toner reservoir section for supplying a toner to a development device; a supply fluid conveyance section for conveying a fluid mixture of toner and air from the toner reservoir section through a supply conveying path; a toner separation section for separating the fluid mixture which has been conveyed by the supply fluid conveyance section into the toner and the air and supplying the toner to the development device; a circulation fluid conveyance section for circulating at least air separated from the fluid mixture, from the toner separation section to the toner reservoir section through a circulation conveyance path; and a capacity variable member connected with the supply conveying path or the circulation conveyance path, capable of absorbing a pressure fluctuation of the fluid mixture or the air by varying a capacity of the member.

10 Claims, 5 Drawing Sheets

TONER REPLENISHMENT DEVICE FOR USE IN ELECTROPHOTOGRAPHIC IMAGE FORMING APPARATUS

BACKGROUND OF THE INVENTION

The present invention relates to the toner replenishment device of an electrophotographic image forming apparatus.

A high-speed image forming apparatus and color image forming apparatus involve a disadvantage that installation of a development device in the vicinity of a toner reservoir section to replenish a toner to the developing device is made difficult by the increased capacity of the toner reservoir section for reserving toner.

In a commonly known toner replenishment technique developed to solve this problem, the toner reservoir section and the developing device are arranged separately to each other, and a toner is conveyed from the toner reservoir section to the development device using the toner conveyance method known as an air conveyance method capable of conveying a toner over a great distance.

The toner replenishment device based on air conveyance is basically composed of a toner reservoir section including a toner mixing chamber, fluid conveyance means for conveying a fluid mixture of toner and air from the toner reservoir section, and a toner separation section for separating toner from the conveyed fluid mixture.

In many of the devices of this type, air separated from toner is led into the mixing chamber through the aforementioned fluid conveyance means, without allowing part of the air to be discharged to the outside.

A circulating type toner conveyance technique is also known, wherein a diaphragm pump is arranged on each of the forward and return conveyance paths so as to allow the aforementioned fluid mixture to be conveyed and returned (e.g. Patent Document 1 indicating Japanese Patent Tokkai 2000-137376).

A pressure fluctuation called pulsation occurs to the diaphragm pump by its very nature. When two diaphragm pumps are used, interference between the pressure fluctuations produced by each of the pump, with the result that pressure fluctuation are offset by each other, on the one hand. On the other hand, the pressure fluctuation is doubled when overlapped. Unless means are taken to place the pressure fluctuation under control, toner may be scattered out of the unit connections with the development device.

At the time of maintenance, the development device must be removed from the connection with the toner replenishment unit. To control the aforementioned scattering of toner, the connection of the unit can be sealed with rubber gasket, but this may cause poor workability at the time of maintenance. To avoid this problem, foamed urethane is used for sealing in many cases. According to this method, however, the strength of the sealing material will be overcome by pressure fluctuation so that toner will be scattered if there is a large pressure fluctuation.

Another method is to provide the aforementioned toner separation section with a filter so that part of air is released to the outside so as to adjust the air pressure. However, this method involves the need of filter replacement work, and causes earlier clogging of the filter. This may also cause toner to scatter. Further, a method of controlling the speed of each of the motors for driving two pumps or a method of controlling the conveyance flow rate of the fluid mixture sent from two pumps is also proposed (e.g. Patent Document 1 mentioned above).

The pump motor speed, however, is about 2,000 through 5,000 rpm. It is extremely difficult to control the speed in such a way that the two motor speeds will be equal to each other. Such a method is insufficient to provide a reliable solution to the problem. Accordingly, it is not easy to reduce this pressure fluctuation.

SUMMARY OF THE INVENTION

The object of the present invention is to provide a toner replenishment device using a simple mechanism to absorb the pressure fluctuation of the fluid mixture of toner and air to the fullest extent possible and to prevent toner from scattering out of the conveyance path, thereby ensuring smooth flow of the fluid mixture through the conveyance path.

The aforementioned object of the present invention can be achieved by the following structure.

A toner replenishment device comprises: a toner reservoir section for supplying a toner to a development device; a supply fluid conveyance section for conveying a fluid mixture of toner and air from the toner reservoir section through a supply conveying path; a toner separation section for separating the fluid mixture which has been conveyed by the supply fluid conveyance section into the toner and the air and supplying the toner to the development device; a circulation fluid conveyance section for circulating at least the air separated from the fluid mixture, from the toner separation section to the toner reservoir section through a circulation conveyance path; and a capacity variable member connected with the supply conveying path or the circulation conveyance path, capable of absorbing a pressure fluctuation of the fluid mixture or the air by varying a capacity of the member.

The capacity varying means arranged along the conveyance path varies the capacity in conformity to the pressure fluctuation of the fluid mixture or air. This arrangement allows the pressure fluctuation of the fluid mixture or air pressure to be absorbed by a simple mechanism, whereby the problem of toner scattering can be solved.

DETAILED DESCRIPTION OF THE PREFERRED EMBODIMENT

The following describes an example of the embodiment with reference to drawings. It should be apparent that the following description does not restrict the scope of the art mentioned in the appended structure or the terminologies used therein.

Figure 1:
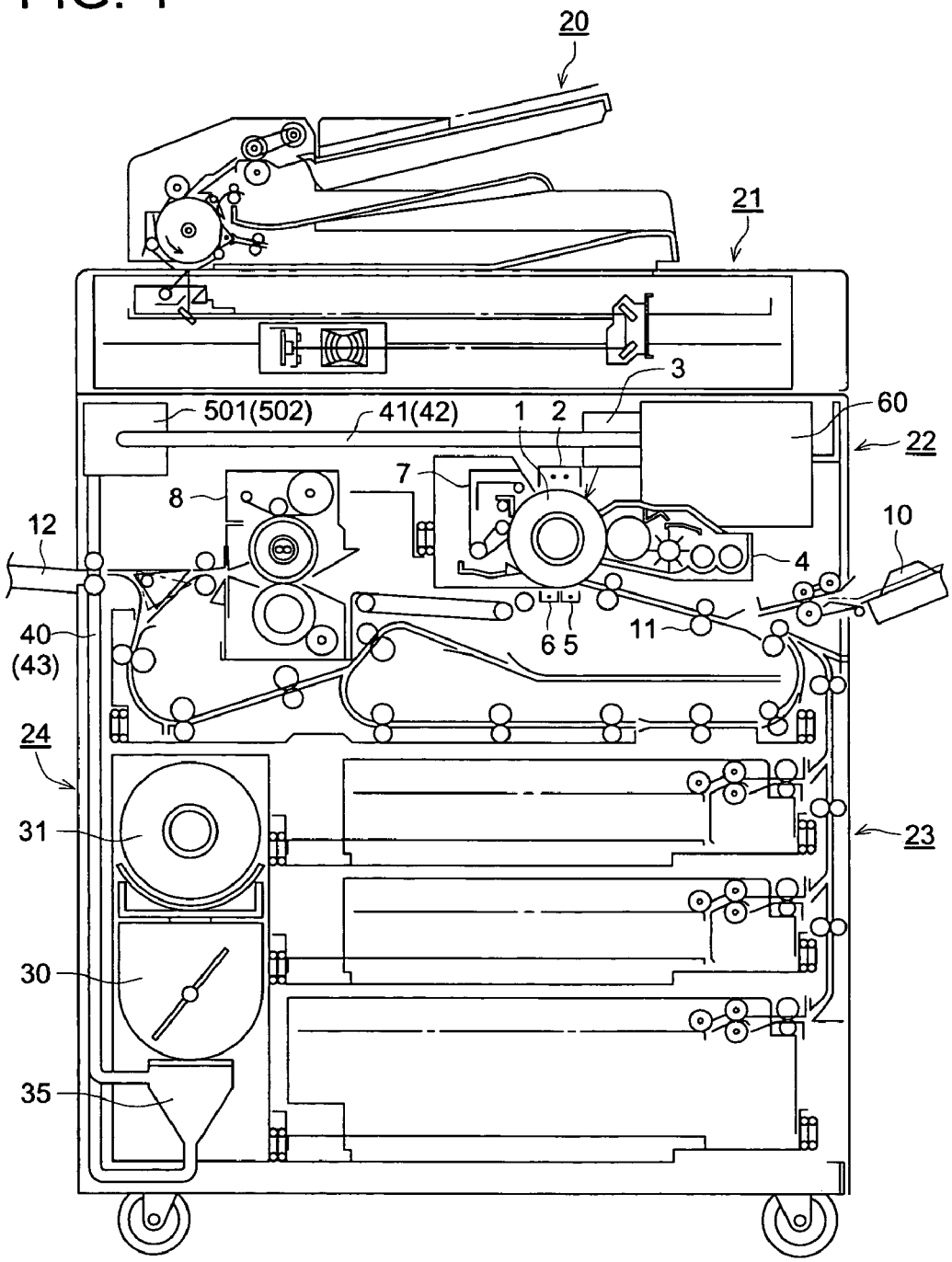
FIG. 1 is a schematic drawing representing the overall configuration of an image forming apparatus provided with a toner replenishment device of the present invention.

FIG. 1 is a schematic drawing representing the overall configuration of an image forming apparatus provided with a toner replenishment device of the present invention.

In FIG. 1, an automatic document conveyance apparatus 20 conveys each sheet of the documents placed on a document platen to the reading position, and stacks the documents having been read, onto the document ejection tray.

A document reading section 21 reads the image on the document and generates digital image data.

The image forming section 22 forms an image on recording paper according to the electrophotographic method.

The image forming section 22 contains a charging device 2, an exposure device 3, a development device 4, a transfer device 5, a separation device 6, and a cleaning device 7 arranged around a drum-shaped photoconductor 1. A paper feed section 23 equipped with a plurality of recording paper storage sections is arranged below the image forming section 22, and feeds recording paper to the image forming section 22. Numeral 10 denotes a manual feed section. The paper fed from the paper feed section 23 or manual feed section 10 is supplied between the photoconductor 1 and transfer device 5 by registration rollers 11, and is ejected into an ejection tray 12 after having been subjected to the processing of fixing by a fixing apparatus 8.

In conformity to the clockwise rotation of the photoconductor 1, electric charging is provided by the charging device 2, the image is subjected to exposure by the exposure device 3, and development is provided by the development device 4, whereby a toner image is formed on the photoconductor 1. The formed toner image is transferred onto recording paper by the transfer device 5. The recording paper with the toner image transferred thereon is ejected into the ejection tray 12 after having been subjected to processing of fixing by the fixing apparatus 8.

An electrostatic latent image on the photoconductor 1 is developed by the development device 4 using a two-component developer containing toner and carrier, or one-component developer containing toner or toner including additive, without containing carrier. The development device 4 stores a predetermined amount of developer. When the two-component developer is used, the toner used for development is replenished from the toner reservoir section 24 to be described below so that the toner density of the developer in the developing device is kept at a predetermined value. Further, in a developing device using one-component developer, the amount of developer in the developing device is kept at a predetermined value by the similar procedure of toner replenishment.

A toner container 31 is incorporated in the toner reservoir section 24. The toner reservoir section 24 has a toner hopper 30 and a funnel-shaped mixing chamber 35, as a destination of toner, for mixing air with toner. The toner separation section 60 as a toner destination arranged close to the development device 4 and the toner reservoir section 24 arranged widely separated from the development device 4 are connected by pipes 40 through 43 as transport pipes. At least some of the materials constituting the pipes 40 through 43 are flexible members of silicone rubber or fluorine resin, and at least some of these pipes are metallic pipes.

Figure 2:
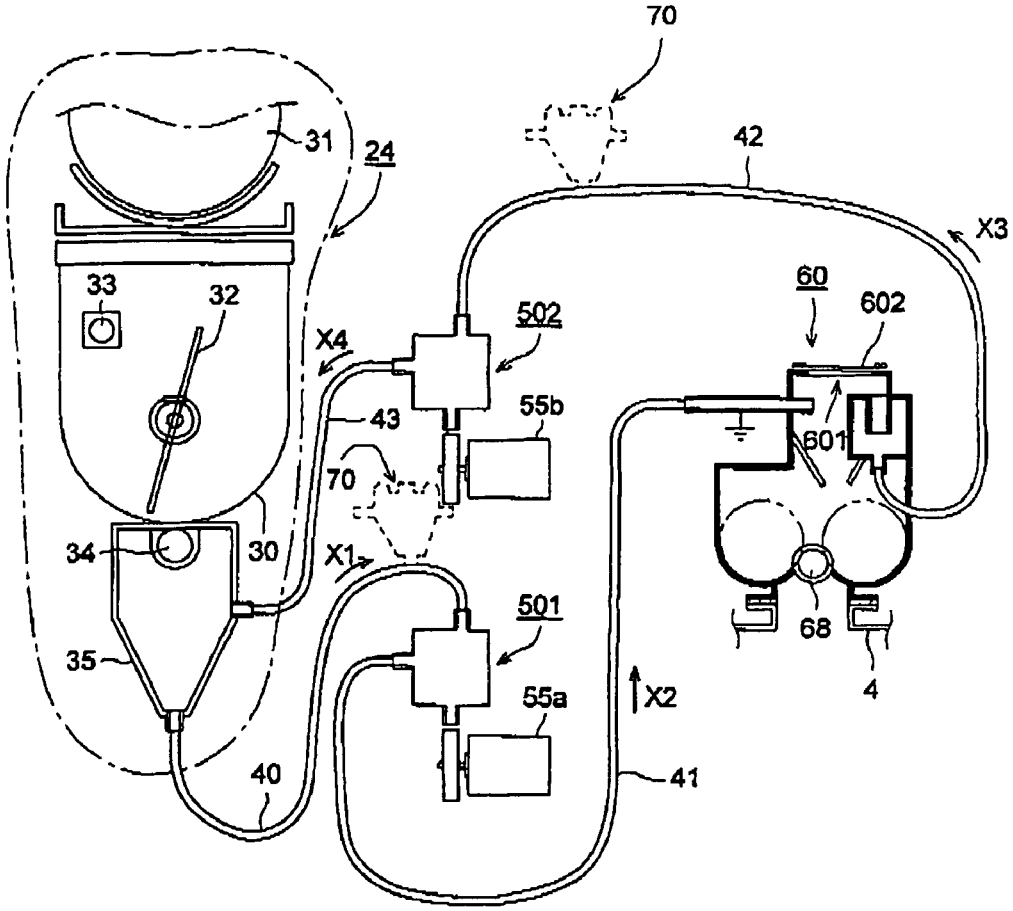
FIG. 2 shows the toner replenishment device of the image forming apparatus shown in FIG. 1.
Figure 3:
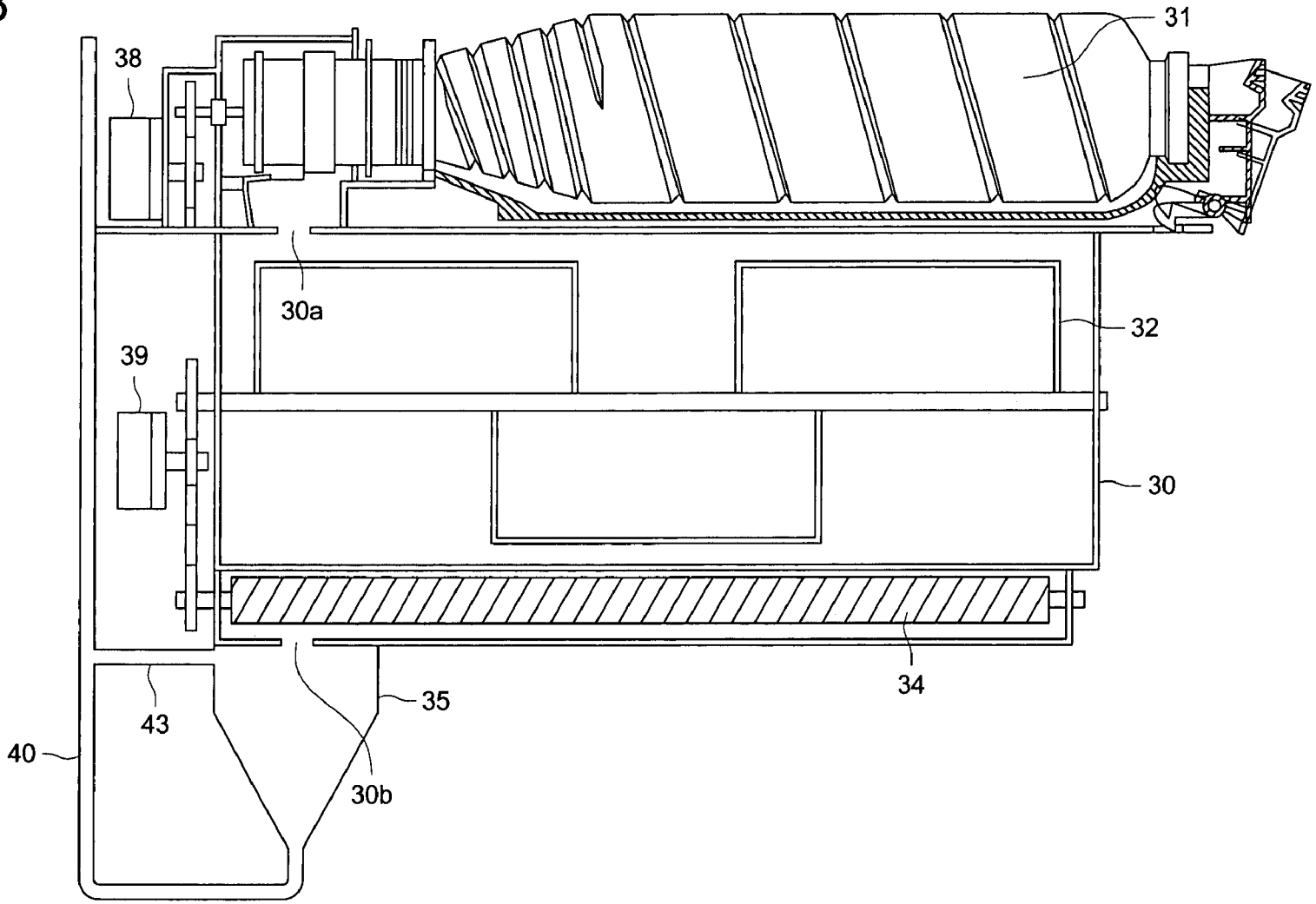
FIG. 3 is a drawing representing a toner reservoir section.

Referring to the FIGS. 2 and 3, the following describes the toner replenishment device:

FIG. 2 shows the toner replenishment device of the image forming apparatus shown in FIG. 1. FIG. 3 is a drawing representing a toner reservoir section.

The toner replenishment device is composed of a toner reservoir section 24, pumps 501 and 502 as a supply fluid conveyance means and a circulation fluid conveyance means respectively, for fluid mixture, a toner separation section 60, and pipes 40 through 43 as toner conveyance paths.

In FIG. 3, a cylindrical toner container 31 is loaded on the toner reservoir section 24, and the toner container 31 is driven and rotated by the motor 38, whereby toner is dropped into the toner hopper 30 through the opening 30*a* from the toner container 31. The toner hopper 30 is provided with a rod-shaped stirring member 32 with a plurality of U-shaped portions formed thereon, and a transport screw 34.

The stirring member 32 and transport screw 34 are turned by the rotation of the motor 39. Toner falls into the mixing chamber 35 from the toner hopper 30 through the opening 30*b*.

Air is supplied to the mixing chamber 35 through the pipe 43, as will be described later, and a fluid mixture of toner and air is formed.

Figure 4:
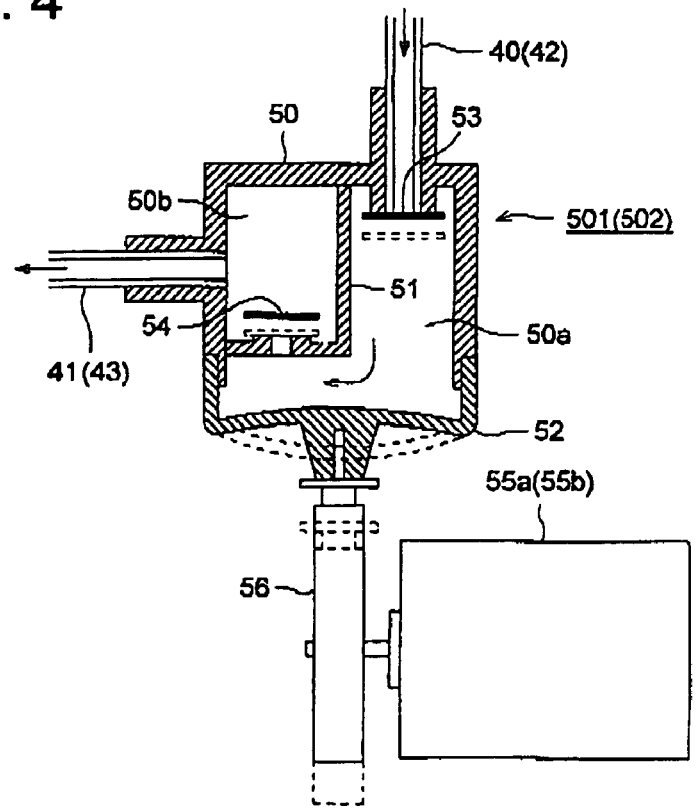
FIG. 4 is a cross sectional view representing the structure of a diaphragm pump.

FIG. 4 is a cross sectional view representing the structure of a diaphragm pump.

The supply fluid conveyance means and the circulation fluid conveyance means use the pumps 501 and 502 respectively, composed of the diaphragm pumps shown in FIG. 4. It is also possible to use a desired type of commonly known pumps or fan such as the screw pumps disclosed in the Official Gazette of Japanese Patent Tokkaihei 7-219329. The pump 501 constitutes the supply fluid conveyance means for conveying a toner and air fluid mixture from the mixing chamber 35 (FIG. 2) to the toner separation section 60, and the pump 502 constitutes the circulation fluid conveyance means for returning the unseparated toner and air from the toner separation section 60 as a toner container to the mixing chamber 35. The pumps 501 and 502 of the same structure are used in the illustrated example, but the supply fluid conveyance means and circulation fluid conveyance means may have a different structure.

Referring to the FIGS. 2 and 4, the following describes the pumps 501 and 502. The pumps 501 and 502 share the same structure as shown in FIG. 4.

The air inlet of the pump 501 is connected to the pipe 40, and the exhaust port is to the pipe 41. The air inlet of the pump 502 is connected to the pipe 42, and the exhaust port is to the pipe 43. The pump chamber formed by the outer wall 50 is partitioned by the inner wall 51 into an air supply chamber 50*a* and an exhaust chamber 50*b*. The air inlet of the air supply chamber 50*a* is provided with a valve 53, and the vent of the exhaust chamber 50*b* (vent formed on the inner wall 51) is with a valve 54.

Part of the outer shape of the pumps 501 and 502 is made up of a diaphragm 52. The diaphragm 52 is driven by an eccentric rotary member 56 that is driven by the motor, and is deformed into the states indicated by the solid line and broken line.

The eccentric rotary member 56 is rotated by the pump motors 55*a* (55*b*) as two power sources, and this rotation causes the diaphragm 52 to be deformed into the states indicated by the solid line and broken like. Then the capacity of the air supply chamber 50*a* is changed so that the pressure inside the air supply chamber 50*a* is increased or decreased. The increase or decrease of this pressure causes valves 53 and 54 to be changed into the states shown by the solid line and broken line, so that the fluid is fed in one direction shown by the arrow mark.

The following describes the toner separation section 60.

Figure 5:
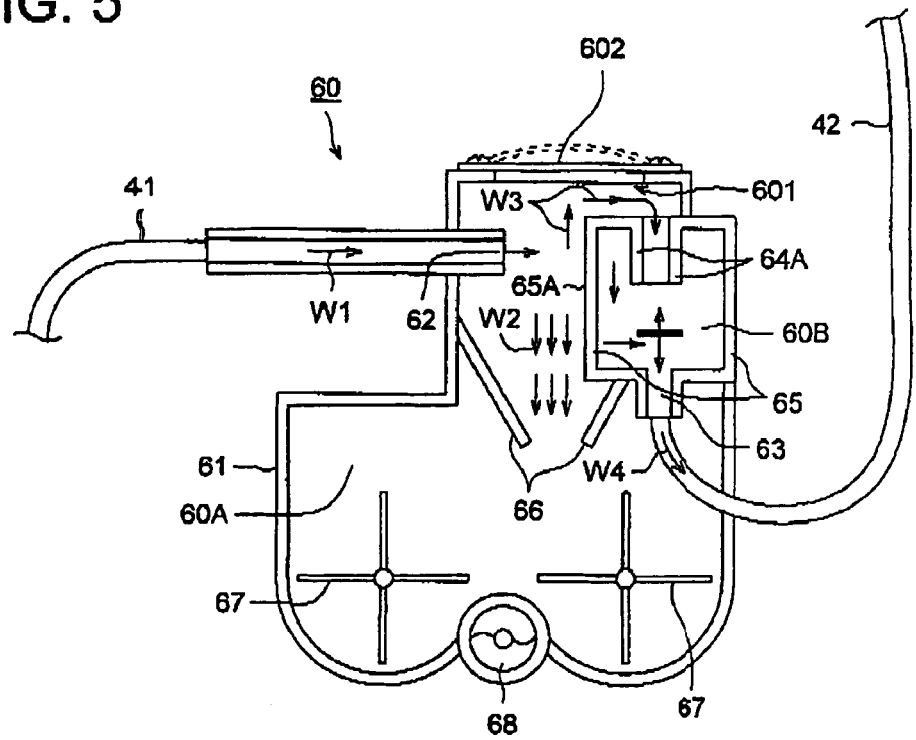
FIG. 5 is a cross sectional view representing structure of a toner separation section.

FIG. 5 is a cross sectional view representing structure of a toner separation section.

The toner separation section 60 is equipped with the outer wall 61 forming the outer diameter of the toner separation section 60, the inner wall 65 for separating the interior of the toner separation section 60 into the introduction chamber 60A and exhaust chamber 60B, and the auxiliary inner wall 66.

The introduction chamber 60A is equipped with an air inlet 62, and the exhaust chamber 60B is provided with an air outlet 63. The auxiliary inner wall 66 guides the toner to fall down, and reduces rise of the toner level in the introduction chamber 60A. A stirring member 67 having a blade, and a screw 68 for feeding toner in the axial direction are mounted on the bottom of the toner separation section 60. A toner and air fluid mixture is led from the air inlet 62 to the introduction chamber 60A, as indicated by the arrow mark W1, and falls down, as indicated by the arrow mark W2. The introduction chamber 60A is filled with fluid mixture. Receiving the pressure due to the fluid conveying force by the pump 502 (FIG. 2), a partial rise is observed, as indicated by the arrow mark W3, and then the mixture is fed to the exhaust chamber 60B. Toner concentration in the fluid mixture rising in the direction indicated by the arrow mark W3 is reduced by the specific gravity of the toner and action of the auxiliary inner wall 66, with the result that the fluid mixture consists only of air. The fluid mixture in the exhaust chamber 60B is discharged from the air outlet 63 as indicated by the arrow mark W4.

As can be seen from FIG. 5, a communicating path is created in such a way that the fluid mixture is made to snake its course by the vertical portion 65A of the inner wall 65 and vertical portion 64A. The amount of toner contained in the air to be discharged is reduced by such a communicating path allowing a snaking movement of the fluid mixture. The vertical portions 65A and 64A are cylindrical, and the cylinder of the vertical portion 64A is arranged inside the cylinder of the vertical portion 65A.

The following describes the path of toner.

Returning to FIG. 2, the mixing chamber 35, pumps 501 and 502 and toner separation section 60 are connected by the pipes 40 through 43.

Air is circulated by the pump 501 from the mixing chamber 35 to the pump 501 as shown by the arrow mark X1 and from the pump 501 to the toner separation section 60 as shown by the arrow mark X2, whereby tone is supplied. Further, air is also circulated by the pump 502 from the toner separation section 60 to the pump 502 as shown by the arrow mark X3, and from the pump 502 to the mixing chamber 35 as shown by the arrow mark X4. Toner is then separated by the toner separation section 60, and is supplied to the development device 4 by the screw 68 (FIG. 1).

The toner replenishment device shown in FIGS. 2 through 5 performs the following operations along the aforementioned path.

The amount of toner in the toner hopper 30 is detected by a toner sensor 33 using a piezoelectric element. If the toner level is reduced below the level detected by the toner sensor 33, the motor 38 operates according to the command from control means (not illustrated). Then toner is supplied from the toner container 31 to the toner hopper 30.

Further, when toner concentration in the development device 4 is reduced below a predetermined level, a replenishment signal is issued to indicate that toner should be replenished from the control means (not illustrated) to the development device 4. In response to this signal, the motor 39 shown in FIG. 3 operates to drive the stirring member 32 and to stir toner in the toner hopper 30. At the same time, it drives the screw 34 so that toner falls down into the mixing chamber 35. The pump motors 55*a* and 55*b* are operated in response to the replenishment signal, thereby allowing the pumps 501 and 502 to operate. An air stream is produced inside the mixing chamber 35 by the operation of the pumps 501 and 502 and the toner is mixed with air. The fluid mixture is fed to the toner separation section 60 through the pipes 40 and 41 by the conveyance force of the pump 501.

The toner separated by the toner separation section 60 is conveyed to the development device 4 by the screw 68. The toner and air fluid mixture unable to be separated is circulated back to the mixing chamber 35 by the force of conveyance of the pump 502 through the conveyance pipes 42 and 43.

The above description refers to the configuration and operation of the toner replenishment device of the present embodiment.

The following describes the details of the present invention.

As described above, in the prior art, when the pressure balance on the sides of pipes 41 and 42 is destroyed by the fluctuation of the speed of the pump motor 55*a* (55*b*), a filter was arranged on the toner separation section 60 in order to reduce the pressure fluctuation. This filter was used to release part of air to the outside, thereby adjusting the air pressure. This was accompanied by earlier clogging of the filter and scattering of toner, with the result that burdensome work of filter replacement was essential. Further, toner was scattered from the seal between the development device 4 and toner storage product, according to the prior art.

The present invention provides an apparatus capable of minimizing the scattering of toner from the connection with a development-device or the like, without the need of burdensome work of filter replacement.

To put it another way, in the embodiment shown in FIGS. 2 and 5, an opening 601 is arranged on part of the casing of the toner separation section 60 corresponding to the container as capacity varying means for storing toner, as a source or destination for the conveyance of toner, connected to the conveyance path of the fluid mixture. This opening 601 is covered with a cover sheet 602 composed of such as elastic member as a rubber or such a flexible member as a PET (polyethylene terephthalate) to ensure that air in the container does not leak to the outside. If a pressure fluctuation occurs along the conveyance path containing the interior of the container and fluid mixture makes an attempt to leak out, the cover sheet 602 is deformed into the form indicated by the broken line shown in FIG. 5, whereby the capacity of the toner separation section 60 increases, and the pressure fluctuation is absorbed. It is also possible to provide the mixing chamber 35 with the aforementioned opening and cover sheet, which will serve as capacity adjusting means to absorb pressure fluctuation.

In addition to the aforementioned embodiments, it is also possible to arrange such a configuration that the entire casing of the toner separation section 60 or the mixing chamber 35 is made of an elastic member or flexible member so that the capacity can be changed in response to pressure fluctuation, thereby reducing the pressure fluctuation.

In addition to the aforementioned method of changing the capacity of the container, the same effect can be obtained if a small diaphragm whose capacity can be changed in response to the pressure fluctuation, halfway through the conveyance path of the fluid mixture is connected in parallel as capacity adjusting means.

Figure 6:
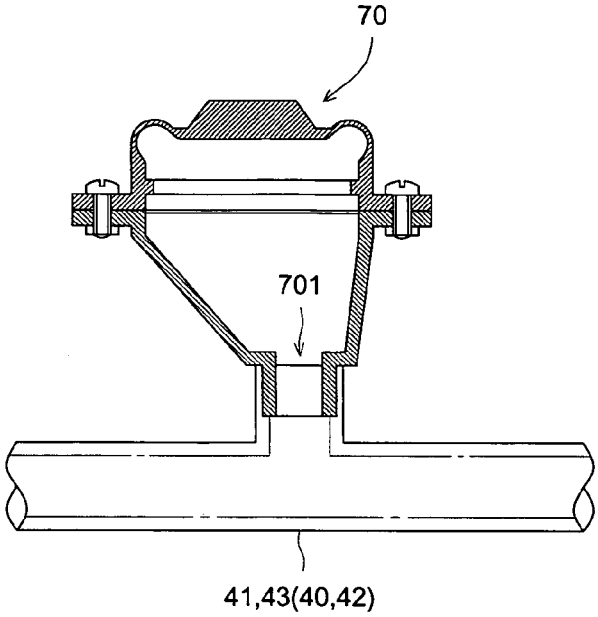
FIG. 6 is a cross sectional view representing the diaphragm arranged in parallel with a conveyance path.

FIG. 6 is a cross sectional view representing the diaphragm arranged in parallel with a conveyance path.

In FIG. 6, numeral 70 denotes a diaphragm as a buffer container, which is arranged along the conveyance path for connecting between the toner storage container and pump. The container for storing toner such as a mixing chamber 35 and toner separation section 60 is usually connected with a pump by a rubber pipe or metallic pipe. This diaphragm should preferably be located close to the pump where the diaphragm is likely to be subjected to pressure fluctuation.

If a pressure fluctuation has occurred in the conveyance path, part of the fluid mixture flows into the diaphragm 70 to cause an increase of pressure in the diaphragm 70. This results in an increase in the capacity corresponding to this pressure, and the buffer effect serves to minimize the impact on toner conveyance by pressure fluctuation. In this case, however, the diaphragm 70 is preferred to be installed in such a way that the vent 701 is located downward, this is intended to prevent toner from remaining inside.

It is also possible to arrange such a configuration that part of the pipe as capacity varying means is made of an elastic member capable of easily deforming in conformity to pressure fluctuation, instead of the diaphragm 70, so that pressure fluctuation is absorbed by the deformation of the elastic member. Further, it goes without saying that various means subjected to deformation due to pressure fluctuation can be utilized in parallel.

The present inventors conducted experiments on a fluctuation of atmospheric pressure inside the toner separation section.

Figure 7:
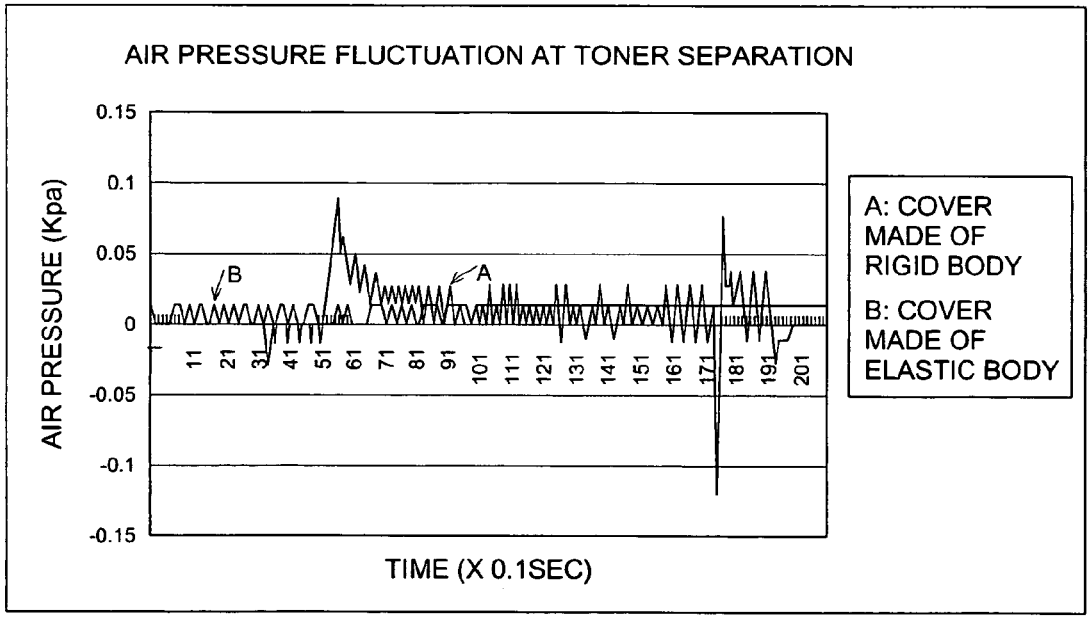
FIG. 7 is a drawing showing the comparison of pressure fluctuations when the cover is made of a rigid body and elastic body in a toner separation section during the operation.

FIG. 7 is a drawing showing the comparison of pressure fluctuations when the cover is made of a rigid body and elastic body in a toner separation section during the operation.

In FIG. 7, the change line A indicates the pressure fluctuation in the toner separation section 60 when the cover as the cover sheet 602 in FIG. 5 is made of a rigid body, while the change line B indicates the pressure fluctuation when the cover is made of an elastic body.

As is apparent from the graph, when the cover sheet is made of a rigid body, a big pressure fluctuation occurs 5.1 sec. and 17.5 sec. and 19.1 sec. after measurement. By sharp-contrast, there is almost no pressure fluctuation when the cover sheet is made of an elastic body. Thus, a big pressure fluctuation can be absorbed by using an elastic member to produce the cover sheet.

The present invention described above ensures stable conveyance of fluid mixture wherein pressure fluctuation is absorbed and scattering of toner is prevented.

What is claimed is:

1. A toner replenishment device comprises:

(a) a toner reservoir section for supplying a toner to a development device;

(b) a supply fluid conveyance section for conveying a fluid mixture of toner and air from the toner reservoir section through a supply conveying path;

(c) a toner separation section for separating the fluid mixture which has been conveyed by the supply fluid conveyance section into the toner and the air and supplying the toner to the development device;

(d) a circulation fluid conveyance section for circulating at least the air separated from the fluid mixture, from the toner separation section to the toner reservoir section through a circulation conveyance path; and (e) a capacity variable member connected with the supply conveying path or the circulation conveyance path, capable of absorbing a pressure fluctuation of the fluid mixture or the air by varying a capacity of the member.

2. The toner replenishment device of claim 1, wherein the capacity variable member is the toner reservoir section or the toner separation section.

3. The toner replenishment device of claim 1, further comprising a first drive source connected with the supply conveying path for conveying the fluid mixture, and a second drive source connected with the circulation conveyance path for circulating at least air.

4. The toner replenishment device of claim 1, wherein the capacity variable member is one of the buffer containers connected in parallel with the toner reservoir section, the toner separation section, the supply conveyance path and the circulation conveyance path.

5. The toner replenishment device of claim 1, wherein the capacity variable member is structured by the supply conveyance path or the circulation conveyance path, at least a part of which is made of an elastic member.

6. The toner replenishment device of claim 1, wherein the capacity variable member is a buffer container connected in parallel with the supply conveyance path or the circulation conveyance path.

7. The toner replenishment device of claim 6, wherein the buffer container is connected with the supply conveyance path or the circulation conveyance path so that a vent of the buffer container faces downward.

8. The toner replenishment device of claim 1, wherein a part or an entire part of a frame forming the capacity variable member is made by an elastic member or a flexible member.

9. The toner replenishment device of claim 8, wherein the elastic member is a rubber member.

10. The toner replenishment device of claim 8, wherein the flexible member is a polyethylene terephthalate sheet.

* * * * *